US012643001B2

(12) United States Patent
Geller

(10) Patent No.: US 12,643,001 B2
(45) Date of Patent: Jun. 2, 2026

(54) FINGER WEIGHT DEVICE

(71) Applicant: Finger Dynamic Inc., Mundelein, IL (US)

(72) Inventor: Andrew S. Geller, Round Lake, IL (US)

(73) Assignee: Finger Dynamic, Inc., Mundelien (IL)

( * ) Notice: Subject to any disclaimer, the term of this patent is extended or adjusted under 35 U.S.C. 154(b) by 82 days.

(21) Appl. No.: 18/638,863

(22) Filed: Apr. 18, 2024

(65) Prior Publication Data

US 2024/0350853 A1 Oct. 24, 2024

Related U.S. Application Data

(60) Provisional application No. 63/460,405, filed on Apr. 19, 2023.

(51) Int. Cl.
*A63B 21/065* (2006.01)
*A63B 23/16* (2006.01)

(52) U.S. Cl.
CPC ..... *A63B 21/065* (2013.01); *A63B 23/16* (2013.01)

(58) Field of Classification Search
CPC .... A63B 21/065; A63B 23/16; A63B 21/4019
See application file for complete search history.

(56) References Cited

U.S. PATENT DOCUMENTS 4,961,568 A * 10/1990 Clark ..... A63B 23/16 473/458
7,662,068 B1 * 2/2010 Geller ..... A63B 23/16 482/44
8,177,667 B2 * 5/2012 Menchio ..... A63B 69/0071 473/422
D780,931 S * 3/2017 Vasishtha ..... D29/120.2
2006/0116245 A1 * 6/2006 Palmenco-Geller ..... A63B 21/065 482/50
2006/0287160 A1 * 12/2006 Geller ..... A63B 23/16 482/44

(Continued)

FOREIGN PATENT DOCUMENTS

CN 210229034 4/2020

OTHER PUBLICATIONS

PCT International Search Report PCT/US2024/025308; Jul. 31, 2024.

*Primary Examiner* — Andrew M Kobylarz
(74) *Attorney, Agent, or Firm* — Adam K. Sacharoff; Much Shelist. P.C.

(57) ABSTRACT

A Finger Weight System have a main central body portion and a pair of end body portions hinged to the main central body portion, allowing the end body portions to flex and hinge away from the main central body portion. A weight holder on each of the body portions for receiving weights. An outwardly bulb-shaped projection located on at least one of the end body portions, wherein the projection is sized to be received in an opening in a strap after the strap has been wrapped around a person's finger. A member hinged to a rear flange member for retaining the strap in position against the main central body portion, the member secured in a locked position against the strap by a front flange member including a tab or upstanding projection that fits into a groove on an end of the member.

7 Claims, 7 Drawing Sheets

(56) References Cited

U.S. PATENT DOCUMENTS

2015/0375038 A1* 12/2015 Palmenco-Geller .....
A63B 21/4023
482/47

* cited by examiner

FINGER WEIGHT DEVICE

CROSS REFERENCE OF THE INVENTION

The present invention claims priority to provisional application 63/460,405 filed Apr. 19, 2023.

BACKGROUND OF THE INVENTION

The present invention relates to a device that is weighted and resiliently securable to a finger to assist in strengthening the finger during use of the finger. Such a strengthening device is invaluable for sports usage, piano playing and other activities where fingers are in constant use and thus in need of strengthening.

DESCRIPTION OF THE PRIOR ART

There are a number of finger weight devices capable of holding a plurality of weights for strengthening fingers. These include U.S. Pat. Nos. 6,413,193 and 7,662,068. These devices while effective require the use of a strap and do not have the desirable flexibility so they can be quickly and effortlessly affixed in position on a figure or removed therefrom. In addition to this high degree of flexibility they lack the ready positioning and removable of weights so that they can readily adapt to varying weight requirements.

SUMMARY OF THE INVENTION

In accordance with the present invention there is illustrated an articulating weight system allowing for the center of gravity to lower as the strap is tightened to a desired fit and tension. This feature is critical as it allows for the center of gravity to remain constant during high velocity movements. An example of a "high velocity" movement would be the torque generated from throwing a baseball at one's maximum speed.

It can be appreciated that this simple and efficient design will not restrict circulation thus allowing the wearer to use the device for an extended period of time without discomfort.

The weight sections each include cylindrical weight holders for receiving weights for the finger weight device. Also included in this embodiment is a centrally disposed weight holder.

BRIEF DESCRIPTION OF THE DRAWINGS

To obtain a better understanding of the invention, reference is made to the accompanying drawings illustrating the invention in which.

DETAILED DESCRIPTION OF THE DRAWINGS

Figure 1:
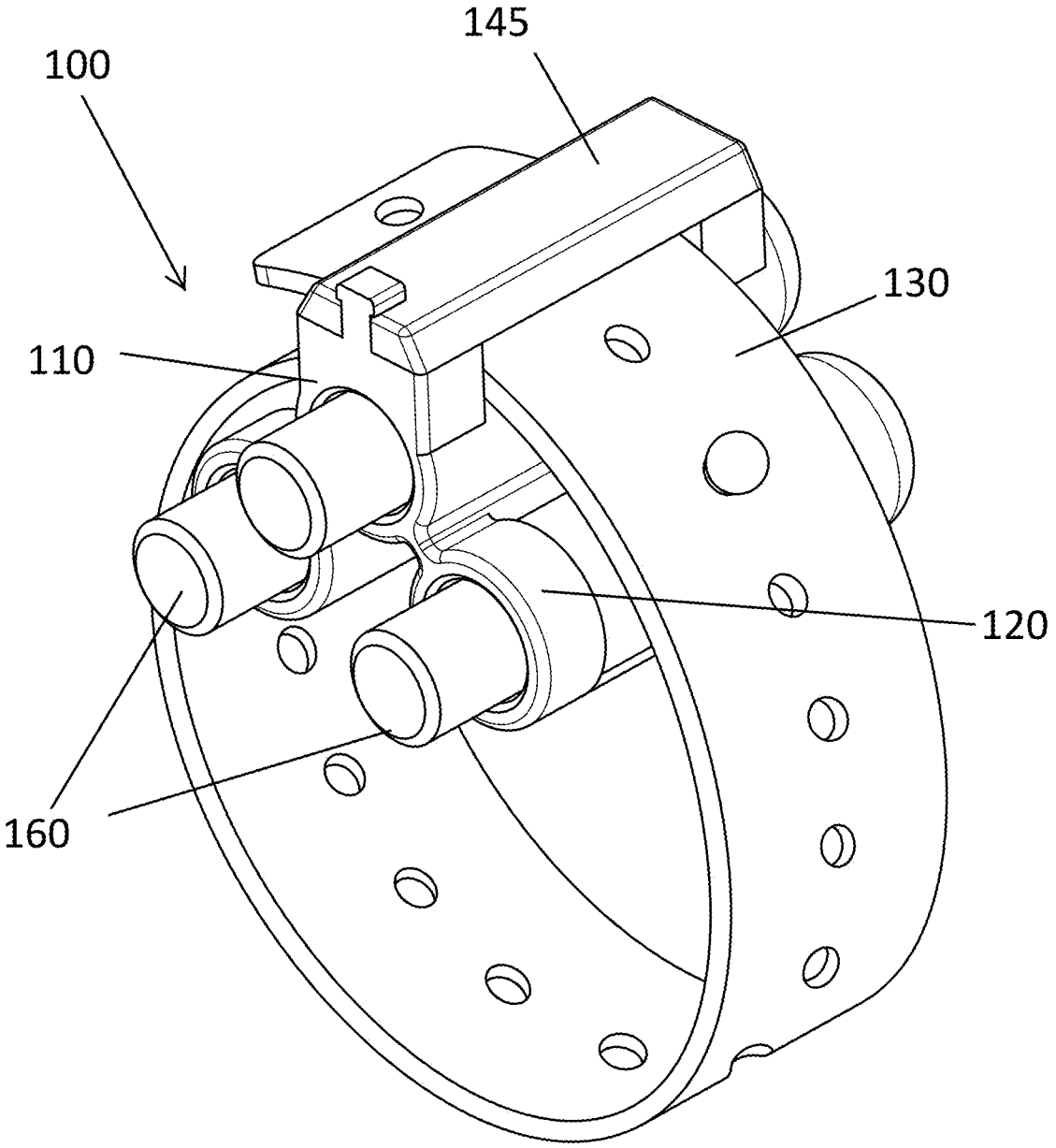
FIG. 1 is a perspective view of the Finger Weight System with an adjustable strap and flexible weight system in a relaxed configuration.
Figure 2:
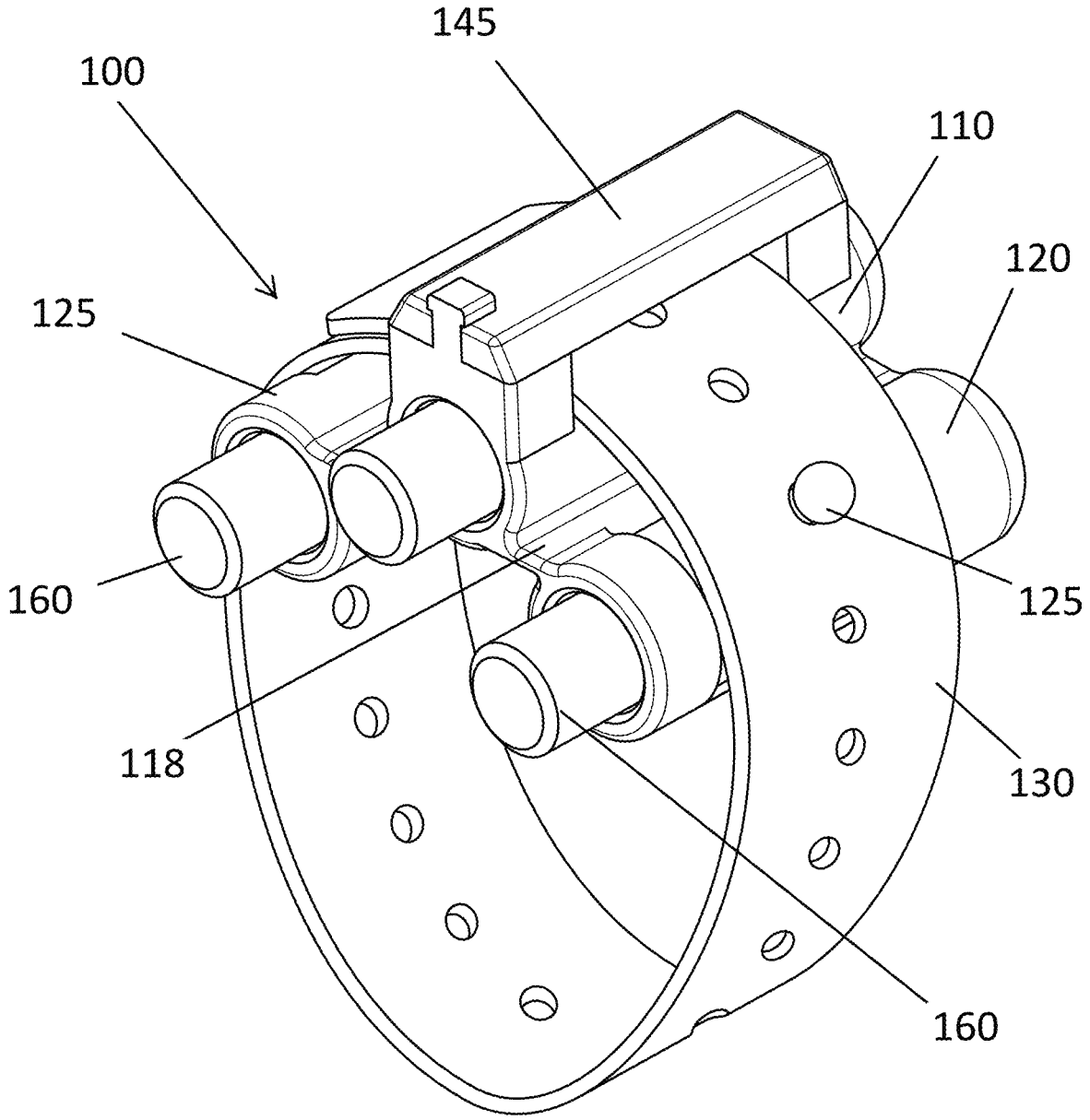
FIG. 2 is a perspective view of the Finger Weight System with an adjustable strap and flexible weight system in a flexed configuration.
Figure 3:
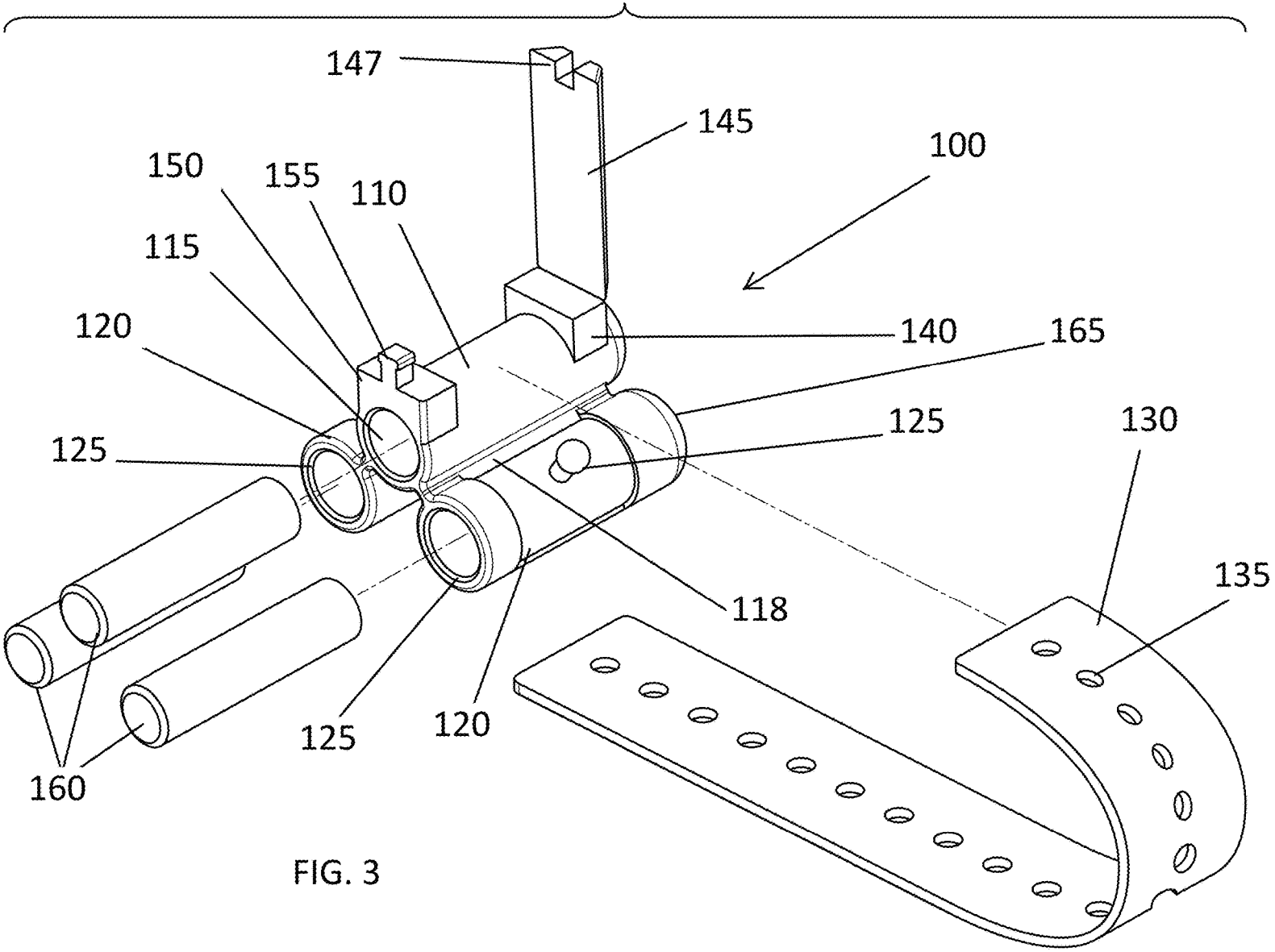
FIG. 3 is an exploded view of the Finger Weight System of FIG. 1.
Figure 4:
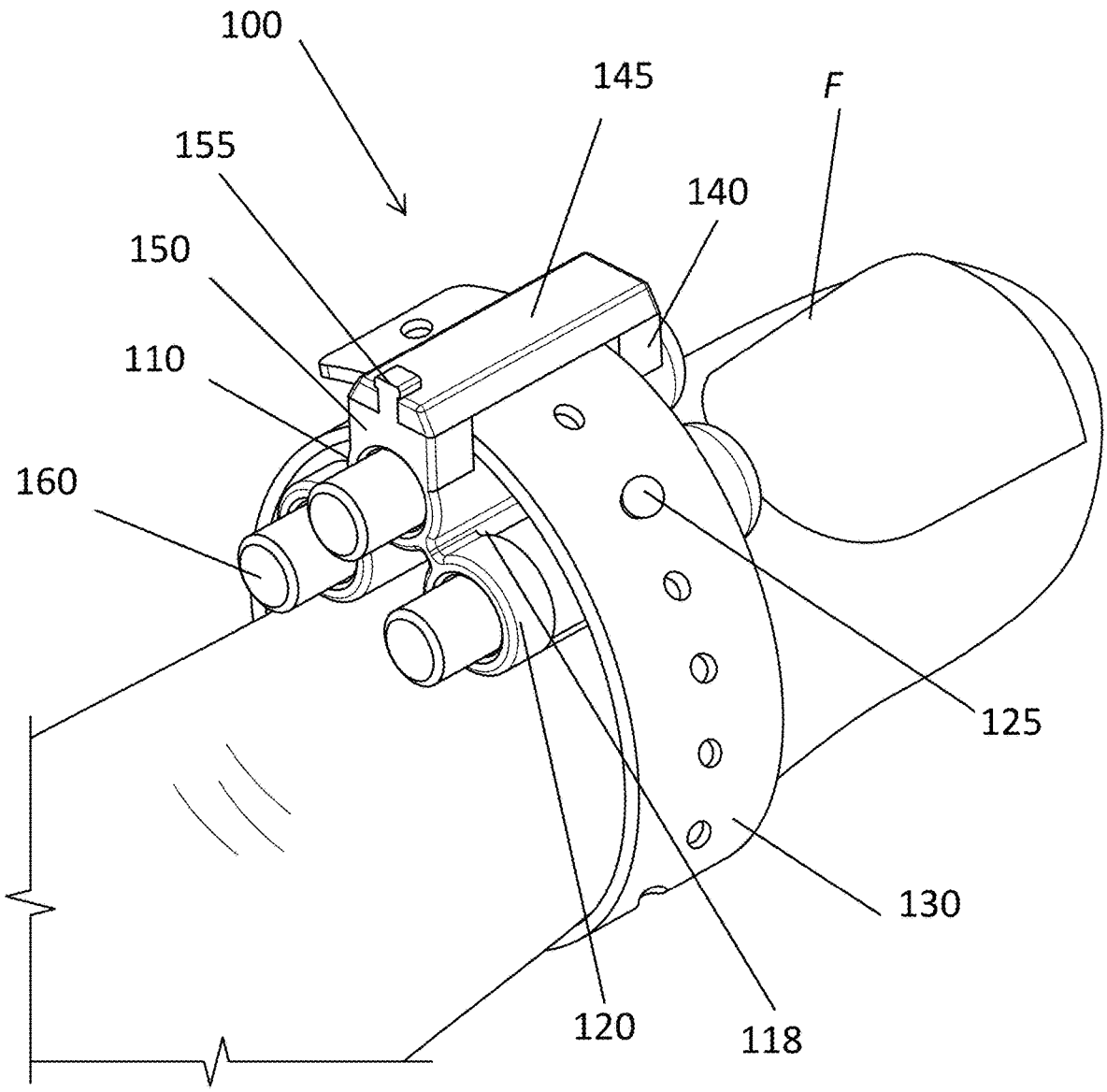
FIG. 4 is a perspective view of the Finger Weight System on a finger while the flexible weight system is in a relaxed configuration.
Figure 5:
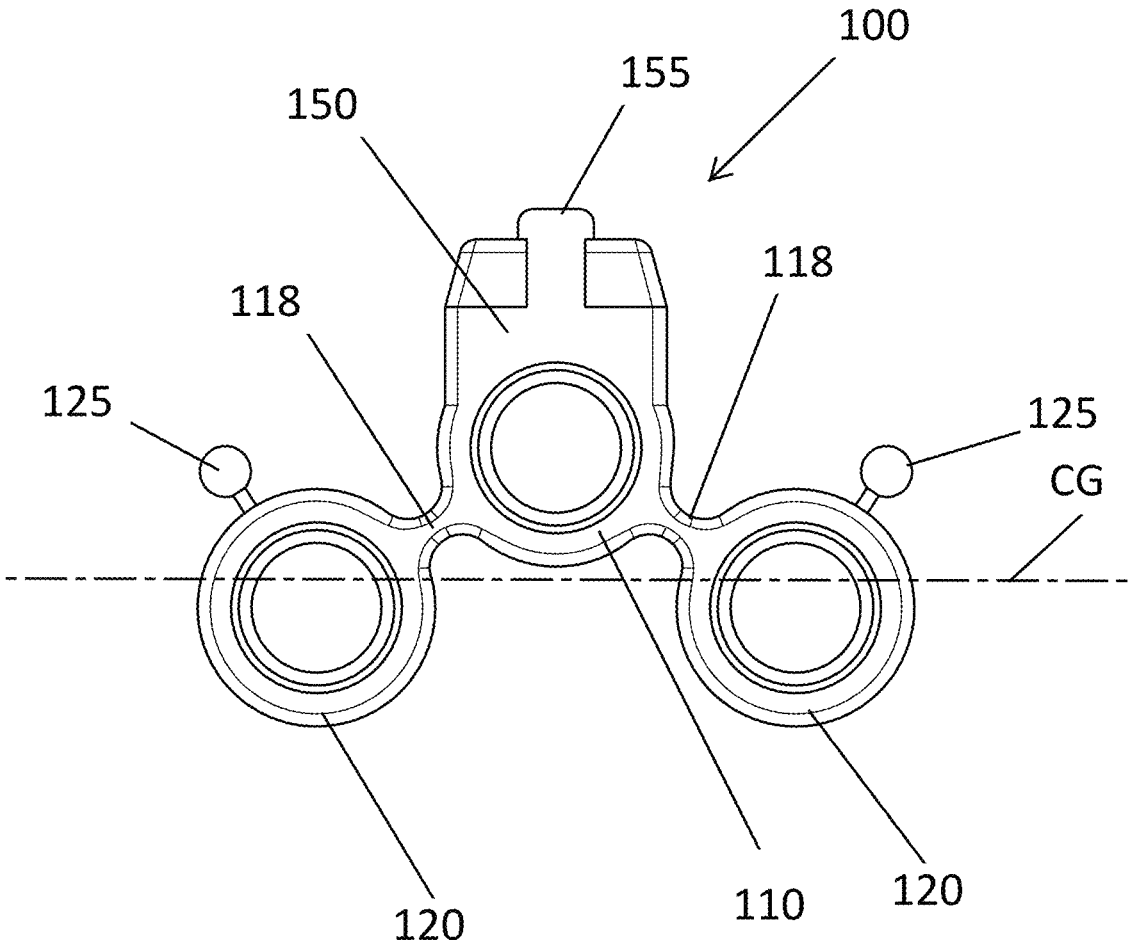
FIG. 5 is a front view of the Finger Weight System in a relaxed configuration.
Figure 6:
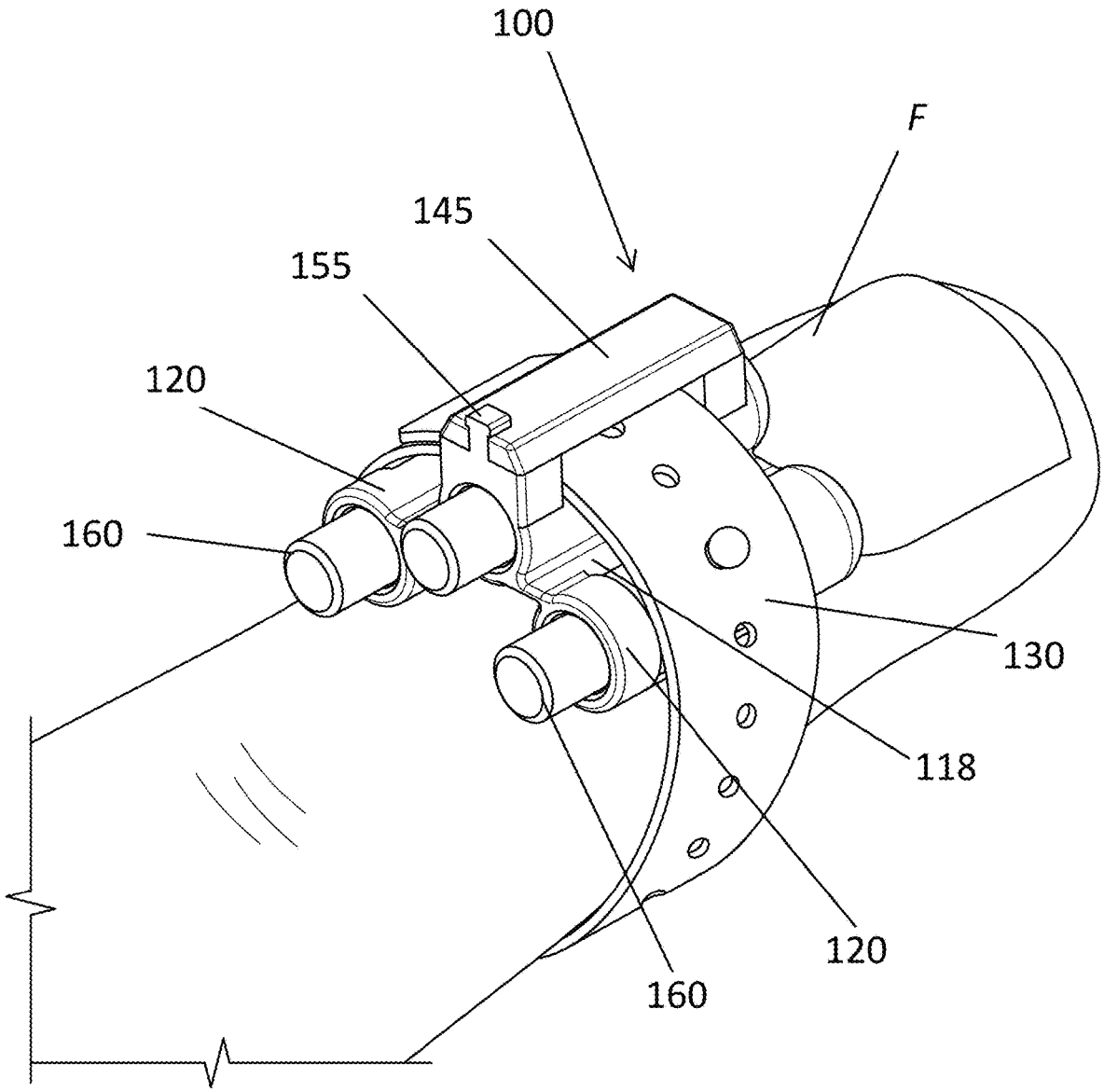
FIG. 6 is a perspective view of the Finger Weight System on a finger while in the flexed configuration.
Figure 7:
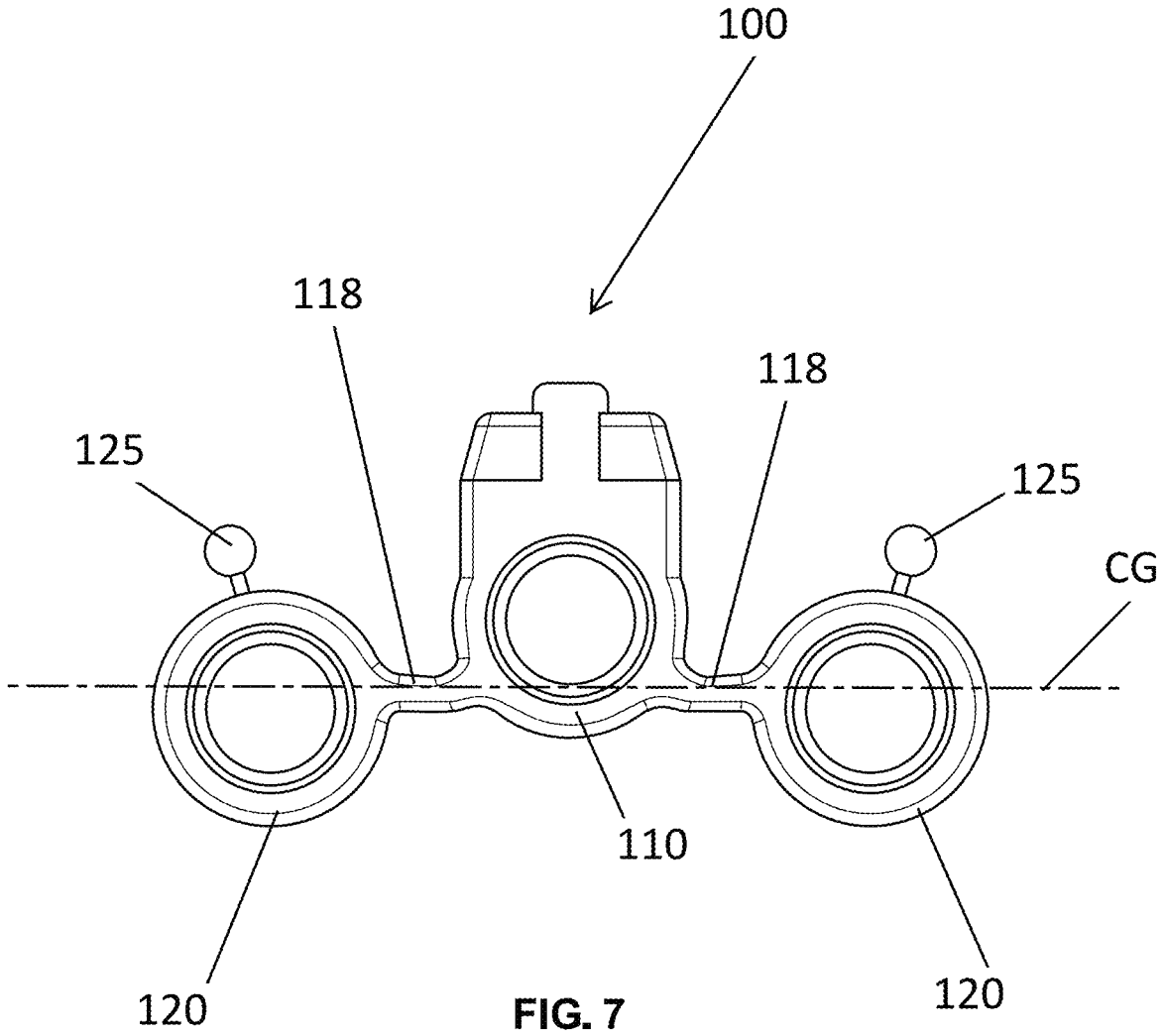
FIG. 7 is a front view of the Finger Weight System in a flexed configuration.

Referring to FIG. 1-7 there is illustrated a Finger Weight System 100 which includes a strap 130 to secure it to a person's finger F.

The Finger Weight System 100 that includes a main central body portion 110 with a pair of end body portions 120 on either side of the central body portion 110. The end body portions 120 are hinged to the main central body portion 110, such that it allows the end body portion to flex or hinge away from each other. In one example, the hinge is a living hinge 118.

Each of the body portions (110 and 120) also include a weight holder 115 and 125, respectively, for receiving weights 105. The width of the central body portions apparat from each other is configured and arranged to fit in an arcuate pattern around the top portion of the finger.

Located on opposite sides of the pair of end body portions 120 are outwardly bulb-shaped projections 125. The projections 125 are sized to be received in openings 135 in the strap 130 after the strap has been tightly wrapped around a finger. Specifically the strap 130 when in the finger-wrapped position has been guided around d the finger and about the outside of the weight holders and located and secured in place by the inter-fitting projections 125 and strap openings 135. While projections are illustrated, the system 100 can use a ratchet type mechanism to tighten and secure the strap. In that embodiment the strap is inserted like a zip tie. It will have a flush release button/lever on top. It could even have a dial to tighten and loosen. The center weight is always in the center of the finger, while the articulating weights move with the size of the finger maintaining a center of gravity at or below the finger line.

To retain the strap 130 in position against the Finger Weight System 100, a member 145 is hinged to a rear flange member 140. To secure the member 28 in a locked position against the strap 130, a front flange member 150 includes a tab or upstanding projection 155 that fits into a groove 147 on an end of the member 145.

The Finger Weight System 100 defines longitudinally extending cylindrical weight holders 115 and 125 for the receipt of cylindrical finger weights 160. The finger weights are in frictional engagement with the holders to retain them in position. One or more weights can be inserted at any given time to vary the weight of the weight member as desired. Furthermore, the material of the weight can also be varied and two material examples that can be employed are stainless steel having an approximate weight of 10 grams/rod or tungsten having an approximate weight of 25 grams/rod. The weight holders do not extend all the way through in that the holders are formed with generally semi-spherical end covers 165.

As illustrated in FIGS. 4-7 the Finger Weight System 100 is placed on a finger F. As the strapped is pulled down and tightened, the pair of end body portions 120 hinge or flex outwardly around the finger moving the center of gravity of the device closer to the center of gravity of the finger.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

I claim:

1. A finger weight system comprising:

a main central body portion;

a pair of end body portions hinged to the main central body portion, allowing the end body portions to flex and hinge away from the main central body portion;

a weight holder on the main central body portion and the pair of end each of the body portions for receiving weights;

a strap having a plurality of openings;

an outwardly bulb-shaped projection located on at least one of the end body portions, wherein the projection is sized to be received in one of the plurality of openings in the strap after the strap has been wrapped around a person's finger; and a member hinged to a rear flange member for retaining the strap in position against the main central body portion, the member secured in a locked position against the strap by a front flange member including a tab or upstanding projection that fits into a groove on an end of the member.

2. The finger weight system of claim 1, wherein the weight holders are configured as longitudinally extending cylindrical holders for receiving cylindrical finger weights, each of the cylindrical finger weights are in frictional engagement with the weight holders to retain them in position.

3. The finger weight system of claim 2, wherein one or more of the cylindrical finger weights can be inserted into each weight holder to vary a weight of the finger weight system.

4. The finger weight system of claim 2, wherein the weight holders do not extend all the way through, and the holders are formed with semi-spherical end covers.

5. The finger weight system of claim 2, wherein the finger weights are made of stainless steel having an approximate weight of 10 grams per rod.

6. The Finger Weight System of claim 2, wherein the finger weights are made of tungsten having an approximate weight of 25 grams per rod.

7. The finger weight system of claim 1, wherein a hinge between the main central body portion and each one of the pair of end body portions is a living hinge.

* * * * *